US012635738B2

(12) United States Patent
Ziehmer

(10) Patent No.: US 12,635,738 B2
(45) Date of Patent: May 26, 2026

(54) OUTDOOR BASE LAYER INCLUDING INTEGRATED KNEE PROTECTION

(71) Applicant: OUT WEST-LIVIN' WILD, LLC, Tucson, AZ (US)

(72) Inventor: T. Richard Ziehmer, Scottsdale, AZ (US)

(73) Assignee: OUT WEST-LIVIN' WILD, LLC, Tucson, AZ (US)

( * ) Notice: Subject to any disclaimer, the term of this patent is extended or adjusted under 35 U.S.C. 154(b) by 0 days.

(21) Appl. No.: 18/737,902

(22) Filed: Jun. 7, 2024

(65) Prior Publication Data

US 2024/0407475 A1 Dec. 12, 2024

Related U.S. Application Data

(60) Provisional application No. 63/472,245, filed on Jun. 9, 2023.

(51) Int. Cl.
*A41B 9/12* (2006.01)

(52) U.S. Cl.
CPC ..... *A41B 9/12* (2013.01); *A41B 2400/38* (2013.01)

(58) Field of Classification Search
CPC ... A41D 13/0543; A41D 13/06; A41D 13/065
USPC ..... 2/24
See application file for complete search history.

(56) References Cited

U.S. PATENT DOCUMENTS

| | | | | |
|---|---|---|---|---|
| 5,500,955 | A * | 3/1996 | Gongea | A63B 71/1225 2/24 |
| 9,615,611 | B2 | 4/2017 | Wyner et al. | |
| 9,770,642 | B2 | 9/2017 | Wyner et al. | |
| D800,420 | S * | 10/2017 | Rivera | D2/731 |
| 9,782,662 | B2 | 10/2017 | Wyner et al. | |
| 9,908,028 | B2 | 3/2018 | Wyner et al. | |
| 11,350,682 | B2 | 6/2022 | Taylor et al. | |
| 2014/0173815 | A1 * | 6/2014 | Grogro | A41D 13/05 2/24 |

OTHER PUBLICATIONS

McDavid, HEX® Basketball Compression ¾ Tight with Knee Padshttps, ://.mcdavidusa.com/products/hex-basketball-compression-three-quarter-tight-with-knee-pads-black? Acessed Mar. 18, 2025.

Light in the box, Men's Running Tights Leggings Compression 3/4 Pants Knee Pads Base Layer Athletic Athleisure Spandex Breathable Quick Dry Moisture Wicking Fitness Gym Workout Basketball Sportswear Activewear Solid #9306188, https://lightinthebox.com/p/men-s-compression-3-4-pants-running-tights-leggings-base-layer-bottoms-athletic-athleisure-spandex-fitness-gym-workout-running-tummy-control-butt-lift_p9306188.html? Accessed Mar. 18, 2025.

(Continued)

*Primary Examiner* — Timothy K Trieu
(74) *Attorney, Agent, or Firm* — Quarles & Brady, LLP

(57) ABSTRACT

A base layer such as an undershirt or long underwear, for outdoor activities is described. The base layer includes an integrated joint protector. The protector includes foam padding realized as a collection of individual, mutually separated pads having a polygonal perimeter. The thickness of the pads decreases from a centerline of the protector to its medial and lateral edges. The medial and lateral edges have triangular individual pads with vertices facing out, which prevents binding or creasing of the protector under flexure.

12 Claims, 7 Drawing Sheets

(56) References Cited

OTHER PUBLICATIONS

EveryMarket, Knee Pads Compression Leg Sleeve Knee Sleeve for All Sports Wrestling Protector Gear, Youth & Adult Sizes, 1 Pair of Knee Paded(Short Sleeve, Black_L_2 Pack) Brand: SZKANI Sold By: Cairomy https://everymarket. com/products/knee-pads-compression-leg-sleeve-knee-sleeve-for-all-sports-wrestling-protector-gear-youth-adult-sizes-1-pair-of-knee-padedshort-sleeveblack_1_2-pack? Accessed Mar. 18, 2025.

* cited by examiner

OUTDOOR BASE LAYER INCLUDING INTEGRATED KNEE PROTECTION

CROSS-REFERENCE TO RELATED APPLICATIONS

This application claims priority to U.S. Provisional Application No. 63/472,245, filed on Jun. 9, 2023, the entirety of which is incorporated herein by reference for all purposes.

FIELD OF THE INVENTION

This disclosure is related to a base layer wearable during strenuous outdoor activities including integrated knee protection.

BACKGROUND

A base layer is a layer designed to be worn next to the skin during strenuous physical activity, particularly strenuous physical activity performed outdoors an especially during cold temperatures. Base layers are typically thin, stretchable and conformable and non-chafing when moist. Base layers typically provide minimal insulation, but are designed to wick moisture (i.e., sweat) from the surface of the skin to the outside surface of the base layer. A base layer's wicking action is provided by fibers arranged roughly normal to the surface of the wearer's skin, which fibers can transport moisture from a first, skin-facing surface of the garment to a second, outward facing surface of the garment by capillary action. From there, the moisture can be further wicked away from the body by additional clothing layers, or it evaporates due to body heat, and the resulting vapor is transported outward to the surrounding environment by a wearer's clothing system. Typical base layers are made of synthetic fabrics (e.g., polyester, nylon, elastane or polypropylene), wool (e.g., merino wool) or silk.

Base layers are typically worn as part of a clothing system including one or more other layers. Such a clothing system, at least for the upper body, may include a base layer and a waterproof or water-resistant outer shell (i.e., a jacket). The shell is typically capable of venting water vapor from the base layer through large vents (e.g., zippered openings under the arm pits or other openings) and/or though the shell fabric itself in cases where the shell comprises a waterproof-breathable fabric. Water-proof breathable materials typically have microscopic pores in the fabric. Warm water vapor evaporating from the base layer (or directly from the wearer's skin) is capable of passing through these small pores in the shell fabric, but liquid water on the outside cannot move through the same pores because of surface tension. Thus, the waterproof-breathable shell is capable of venting water vapor while preventing rain, or the like, from penetrating the jacket. This sort of clothing system keeps the user relatively warm and dry despite high levels of physical exertion and sweating.

In some cases, a clothing system will also include an insulating middle layer, made of some wicking material, or including large gaps in body coverage, so as to not interfere with the passage of vapor from the base layer. Typical middle layers may include an insulated vest (e.g., filled with goose down or some synthetic, low density material) or polyester fleece. For the lower body, where heat loss may be less of a concern, the outer layer may be a wind or water-resistant pant, and the base layer may be relied on for insulation. A clothing system like the one just described is typically worn during outdoor activities like backpacking, day hiking or hunting, because such a system enables a wearer to manage sweat and heat during periods of exertion while maintaining warmth during periods of rest.

When hunting, a hunter must frequently traverse rough, off-trail terrain, and must rapidly transition from walking or running, to a prone or kneeling position (e.g., in order to reduce visibility and prevent themselves from "sky lining" or to take a shot). While kneepads are available to protect a hunter's knees, these are unnecessarily bulky and tend to slip out of position. Certain pants (e.g., "tactical pants") have pockets for receiving knee pads, but again, positioning and fit are problems, since pants that are suitable for hunting tend to be loose fitting, which allows the knee pad to move around with respect to the hunter's knee. Additionally, while there are products available that integrate a knee pad with a base layer the integrated kneepad is monolithic, being composed of a single piece of foam of uniform thickness, which adversely impact the comfort and flexibility of the kneepad. Improvement in these prior art systems would be desirable.

BRIEF SUMMARY

Embodiments of the invention are directed a base layer with integrated knee protection. In one embodiment, the invention includes a base layer pant formed of a thin, elastic and conformable material such as polyester or elastane (polyether-polyurea copolymer) fabric. The base layer is sized to be worn directly next to and tight to the skin. The knee area of the base layer has a knee protector incorporated within the fabric of the base layer on an anterior surface of the base layer. The knee protector, in one embodiment, comprises a plurality of discrete, discontinuous, polygonal padding sections arranged over the wearer's knee, and extending beyond the knee (dorsally, ventrically, medially and laterally). The padding sections may be any soft, conformable material such as closed or open cell foam, gel, non-Newtonian fluid cells, etc. In preferred embodiments, the discrete pads have non-uniform thicknesses, with thicker padding being located in the middle of the knee pad, and progressively thinner pads being located to the medial and lateral sides of the knee. In other embodiments, the knee protector comprises a plurality of non-polygonal padding sections (e.g., circles or ellipses). Inventive embodiments are advantageous over the prior art in that they provide knee protection in the layer that is immediately next to and tight to the skin, and so the knee protection is more likely to stay over the knee with movement of the leg and body. Providing the knee protector as an arrangement of discrete small pads aids in comfort, flexibility and conformability, and varying the thicknesses of the pads reduces the overall size of the pad and preserves its flexibility while still providing adequate padding for the user.

BRIEF DESCRIPTION OF THE DRAWINGS

The drawings described herein constitute part of this specification and includes example embodiments of the present invention which may be embodied in various forms. It is to be understood that in some instances, various aspects of the invention may be shown exaggerated or enlarged to facilitate an understanding of the invention. Therefore, drawings may not be to scale.

DETAILED DESCRIPTION

The described features, advantages, and characteristics may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrase "in one embodiment," "in an embodiment," and similar language throughout this specification may, but do not necessarily, all refer to the same embodiment.

The example embodiments discussed below relate to a lower body base layer with an integrated and integral knee protector comprising plurality of discrete sub-pads of optionally varying thicknesses. This embodiment, however, should not be understood as limiting. The inventive joint protector configurations described may be applied to other areas of the body requiring padding and protection, such as elbows and hips. While the base layer described is a lower body base layer, an upper body base layer (i.e., a shirt) incorporating an elbow protector constructed according to the principals described below is also within the scope of the invention. Additionally, the inventive embodiments may be extended to non-base layers such as pants or over shirts which, themselves, are worn over base layers, or over the skin, but not in the tight-to-the-skin, form fitting configuration of the base layer described below.

Figure 1:
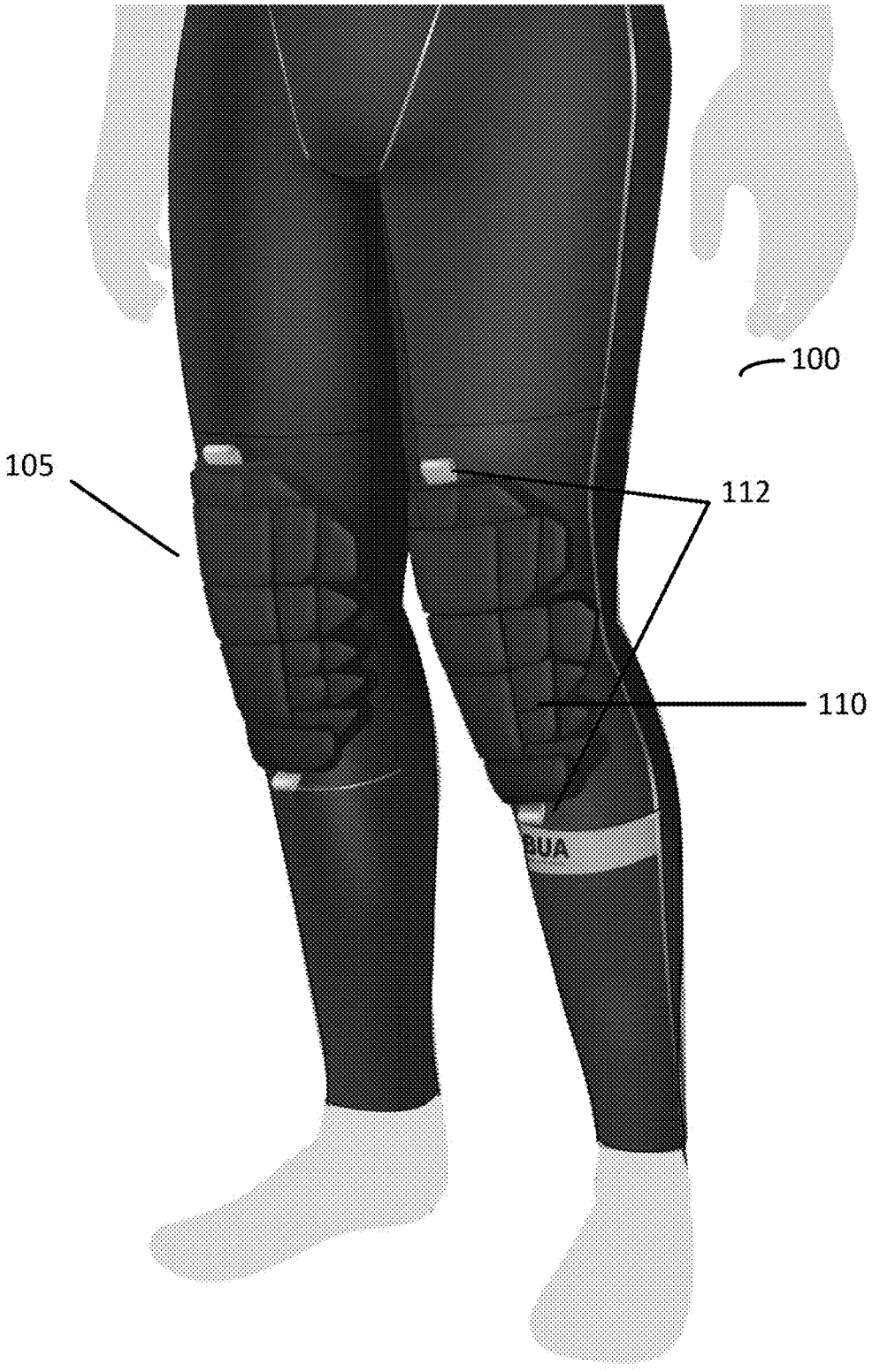
FIG. 1 is a sketch showing an exemplary base layer having an integral joint protector according to an embodiment of the invention.
Figure 2:
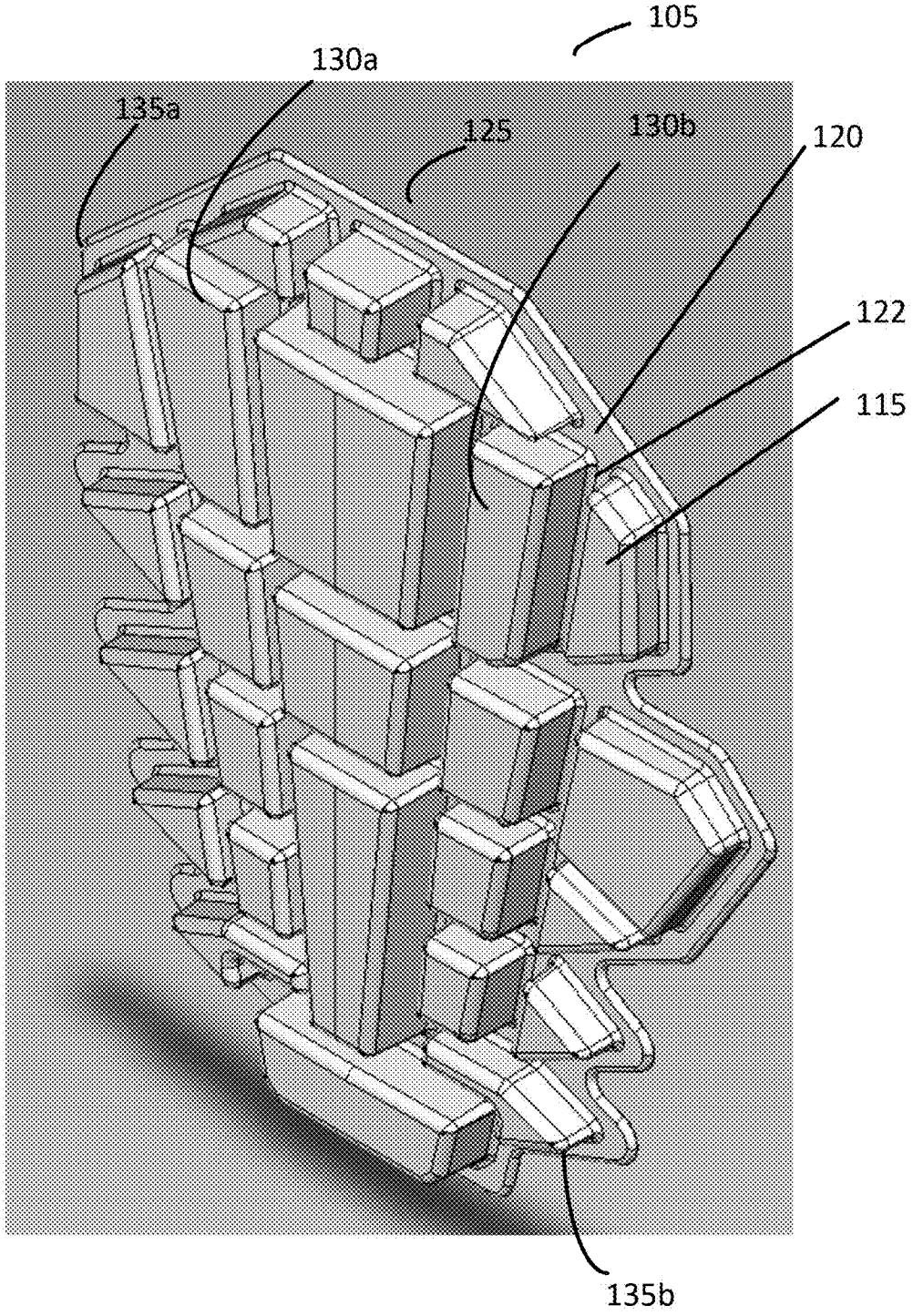
FIG. 2 is an isometric view of one of the joint protectors depicted in FIG. 1.
Figure 3:
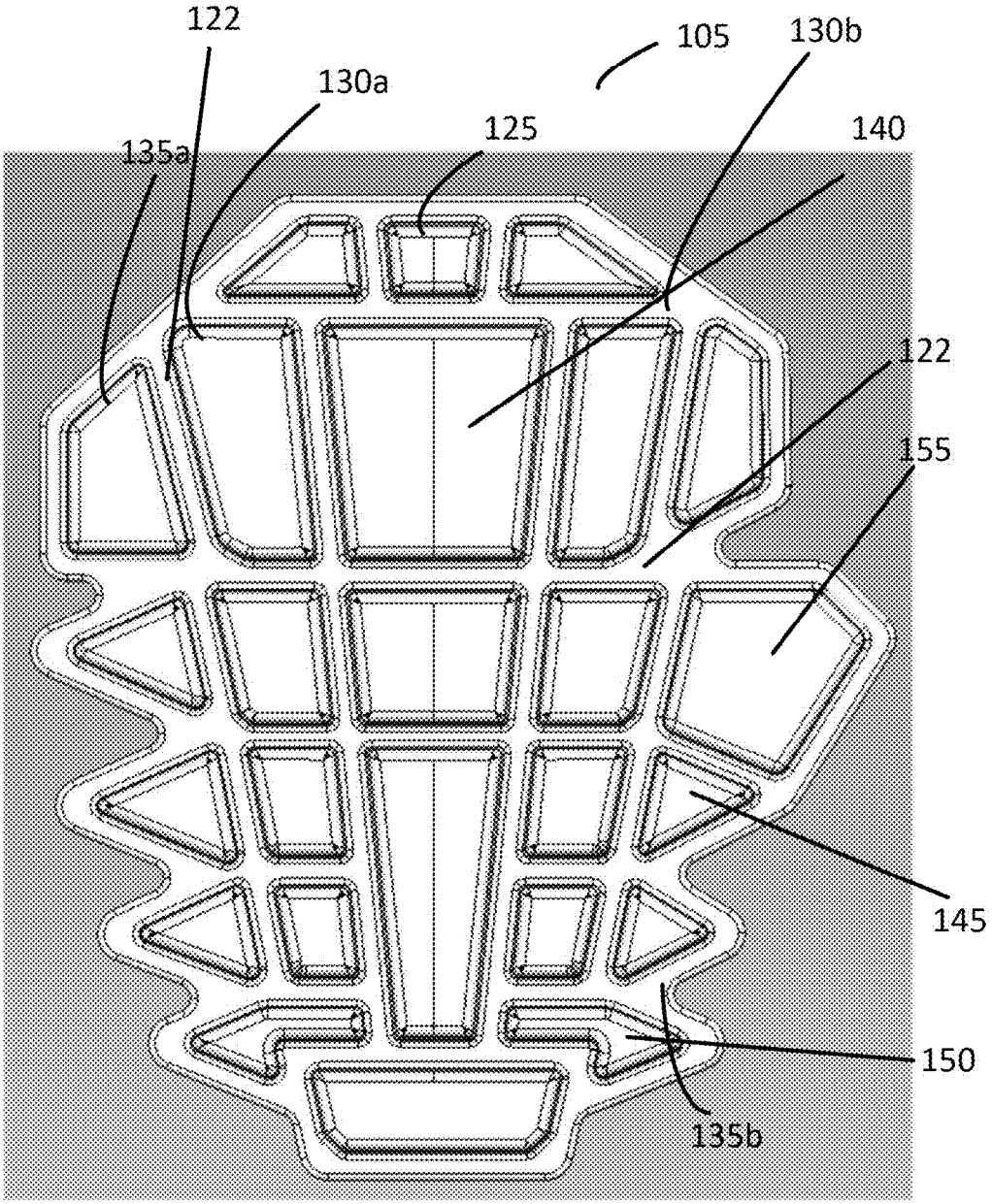
FIG. 3 is a front elevation view of the joint protector depicted in FIG. 2.

Referring now to FIG. 1, there is shown a base layer including left and right integrated joint protectors (e.g., right protector 105 and left protector 110) according to a first and preferred embodiment. In the example of FIG. 1 a garment 100 is provided, which is a base layer. Base layer is 100 is preferably formed of a multilayer fabric such that it includes a first, inside fabric layer that faces in and is in close contact with the skin of the wearer and a second, outside fabric layer that faces out. Both layers are preferably formed of an elastic fabric, and base layer 100 is sized such that it is form fitting. In cases where base layer 100 is a lower body base layer, it preferably extends from waist to ankle, as shown, but in other embodiments it may be shorter, i.e., a ¾ length pant that extends to just below the integrated joint protectors shown at 105, 110. Base layer 100, in other embodiments, may be full length and may include stirrups for the feet, or may be closed at the distal ends and include structures to receive the wearer's feet. In other embodiments, base layer may be an undershirt, configured to be worn on the upper body, in which case the joint protectors 105, 110 may be elbow protectors as opposed to the knee protectors shown in FIG. 1 and described in more detail below. In the case of elbow protectors, they are configured according to the design principles employed below for knee protectors.

Exemplary materials for base layer 100 include cotton, silk, polypropylene, polyester, nylon, and elastane, which is available under trade names such as LYCRA and SPANDEX. Preferably, the material of base layer 100 comprises more than one of the aforementioned or other materials, such as 90% polyester and 10% elastane.

Base layer 100 includes two joint protectors, which in the example of FIG. 1 are knee protectors 105, 110, that are integral to base layer 100 such that they will not slip with respect to the base layer with the wearer's motion. Knee protectors 105, 110 are arranged on an interior side of base layer 100 to cover and protect the knee of a wearer. In certain embodiments, a non-slip patch, strip or strips is arranged on an interior, posterior facing surface of an anterior portion of the base layer 100 (i.e., the inside surface of the front of the garment facing the front of the wearer's knee). Acceptable materials for this patch, strip or series of strips may include silicone, which helps to fix the knee protectors over the knee and prevent slippage. In one embodiment, knee protectors 105, 110 are arranged between a first anterior layer and a second posterior layer of the fabric making up the front of base layer 100 (the portion over the front of the knee) when that fabric is a two or more-layer fabric. In certain embodiments, protectors 105, 110 are arranged in a pocket or enveloped formed in a fabric layer making up the front of the base layer 100. In certain of these embodiments, the pocket or envelope that receives the protectors is sealed, e.g., by being sewn shut or with a layer of adhesive. In these embodiments, the protectors 105, 110 are not removable by the owner of the base layer 100 without cutting or otherwise creating an opening in the fabric of the base layer. In other embodiments, the pocket or envelope receiving the protectors is open (e.g., open to the top) such that a user insert or remove the protectors into the pocket without altering or destroying the base layer fabric itself. In these embodiments where the protector is user insertable and removable, a flap of fabric may be arranged to cover a slit opening in the pocket.

The base layer 100 of FIG. 1 may include projecting tabs 112, which may be formed of a loops of flat, strong fabric. These tabs are centered on the knee protectors and located above and below the knee protectors. These tabs may be used by the wearer to finely adjust the position of the knee protectors during wear.

One embodiment of a left knee protector is shown in detail in FIGS. 2-4 and 7, however, it should be understood that in the inventive garments such as those shown in FIG. 1, the garment will have two such knee protectors, and the right knee protector will be a mirror image (reflected about a vertical line) of the left knee protector shown in FIGS. 2-4 and 7. Right knee protectors of a different embodiment are shown in FIGS. 5-6, but again, it should be understood that a complete garment will include corresponding, mirror-image left knee protectors for embodying garments with the right knee protectors of FIGS. 5-6.

Referring now to FIGS. 1-7, in preferred embodiments, knee protectors 105, 110 comprise a series of conformable and elastic (i.e., pads that deform under force, but then tend to return to their original shape in the absence of force) pads (e.g., 115), of various sizes and shapes. These pads 115 may be fixed to and optionally integral to a knee protector base 120. For example, knee protectors may be molded from closed or open cell foam material, and may be molded on top of base 120, which is also molded at the same time. Alternatively, pads 115 may be fabricated separately (e.g., by molding) and then fixed to base 120, e.g., by adhesive, hook-and-loop fasteners, or the like. Acceptable materials for the pads 115 include closed cell foam (e.g., polyethylene foam, PVC foam, Neoprene, vinyl nitrile, and silicone foam), open cell foam (e.g., polyurethane, open cell rubber, etc.), gels and non-Newtonian fluid cells.

Preferably, pads 115 are mutually discontinuous along their front facing surface, that is to say, knee protectors 105, 110 may not formed of a single piece of foam or cushioning material, but instead, are formed of discrete, small pads separated from one another by gaps, such as the straight line channels 122 depicted in the figures, or alternatively, non-straight channels. By realizing the knee protectors as assemblies of discrete, separated pads, flexibility is increased because the pads may tilt toward and away from one another without interference as the base 120 flexes with the user's motion. Additionally, if the knee protector was formed of a continuous cushion, it would tend to crease or bulge with motion in certain places, which is avoided by providing discrete pads separated by gaps or channels 122. In cases where the individual pads 105, 110 and base 120 are integrally formed in a single process, e.g., by molding or by machining the pads out of a larger piece of material where the base is retained, the channels do not extend through the base, but instead, may extend 50% of the total thickness of the knee protector or more from the front facing surface. The width of the channels separating individual pads may vary, but in preferred embodiments, is between 0.5 and 20 mm. The widths of the channels 122 may be non-uniform or uniform along their length. While the width of all the channels may be the same, preferably, the width of the channels separating vertical columns of individual pads is less than the width of channels separating horizontal rows. This enables more flexure for the protector about a horizontal axis (i.e., the knee's bend axis), than a vertical axis.

While pads 115 may have any shape in certain embodiments (e.g., circles, ellipses or irregular shapes having curved perimeters), preferably, pads 115 have polygonal perimeters. This is advantageous because, under certain flexure conditions, it enables the edges of adjacent pads to meet along a continuous line such that the two pads form a continuous uninterrupted surface. In the arrangement of the Figures, the perimeters of the pads 115 are defined by the straight-line channels 122. In preferred arrangements, horizontal channels are mutually parallel and run substantially horizontally when the knee protector is in a flat, unflexed configuration. This can best be seen in FIG. 3. The horizontal channels permit flexure about horizontal axes, as rows of pads 115 separate from one another at horizontal channels. As noted above, this is advantageous because it allows the pad to flex with direction of motion of the knee joint. Substantially vertical channels (i.e., channels with a vertical component, or non-horizontal channels) run transverse to the horizontal channels. These substantially vertical channels tend to converge toward a point below the knee protector, which results in the knee protector having an overall shape that tapers toward the bottom. The substantially vertical channels 122 allow the pads to flex and separate from one another along the channels. This is advantageous because it allows the protector 105 to be bent into a curve, such that it takes on a conical shape, with a wide, superior opening (to accommodate a wearer's lower thigh, above the knee), and a narrower, inferior opening (to accommodate the thinner upper shin, below the knee). The result is that the pad wraps around the front of the knee, such that the pad is convex towards the wearer's anterior direction, and concave towards the wearer's posterior direction.

In the preferred embodiments of the Figures, individual pads 115 are arranged in substantially horizontal rows, and in columns with a substantial vertical component. As seen best in FIG. 3, there is a first, central column 125 of pads 115 that is centered over the centerline of a wearer's knee, and specifically the centerline of the wearer's kneecap. The preferred embodiments also include a first pair of flanking columns of pads 130*a, b* arranged on either side of the central column 125. The preferred embodiments also include a second pair of flanking columns 135*a, b* located to the outsides of the first pair of flanking columns 130*a, b*. This second pair of flanking columns includes columns located on a medial and lateral edge of the protector 105.

In the illustrated embodiments, the individual pads 115 in the central column of pads 125 have a first thickness, the pads in the first flanking columns 130*a, b* have a second thickness and the pads in the second pair of flanking columns 135*a, b* have a third thickness. More generally, the pads 115 of the protector 105 are arranged in groups, where a first group has a first pad thickness, a second group has a second pad thickness and a third group has a third pad thickness. These groups are preferably arranged with the first group along a vertical centerline of the wearer's knee, the second group arranged a first range of distance from the vertical centerline of the wearer's knee, and the third group arranged yet farther from the vertical centerline of the wearer's knee. In certain embodiments, the first, second and third thicknesses are the same. However, in a preferred embodiment, the first thickness is greater than the second or third thicknesses. In another preferred embodiment the first thickness is greater than the second thickness, and the second thickness is greater than the third thickness. In one embodiment, the first thickness (of the central column of pads) is between 15 and 23 mm, with a preferred thickness of between 17 and 21 mm, and an especially preferred thickness of between 18 and 20 mm. In one embodiment, the thickness of the central pads is about 19 mm or ¾". The thickness of the flanking pads, on either side of the central column of pads is between 12 and 20 mm, with a preferred thickness of between 14 and 18 mm, and an especially preferred thickness of between 15 and 16.5 mm. In one embodiment, the thickness of the central pads is about 15.9 mm or ⅝". In one embodiment, the thickness of the outside most columns of pads is between 9 and 17 mm, with a preferred thickness of between 11 and 15 mm, with an especially preferred thickness of between 12 and 14 mm. In one embodiment, the outermost columns of pad have pads with a thickness of about 12.7 mm or 0.5".

Figure 4:
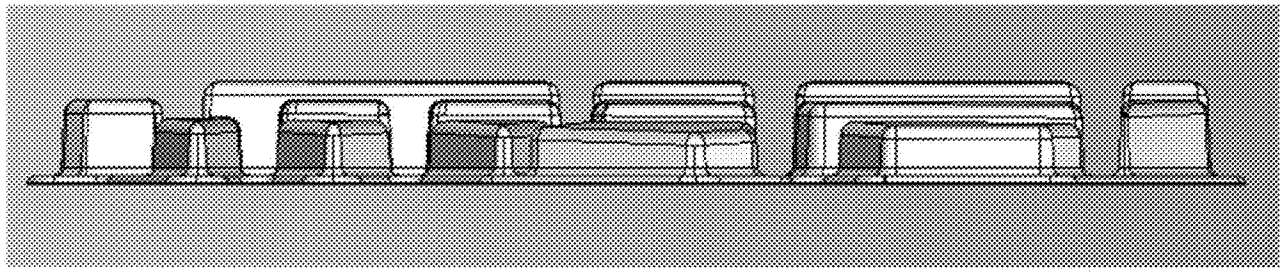
FIG. 4 is a side view of the joint protector depicted in FIG. 2.
Figure 7:
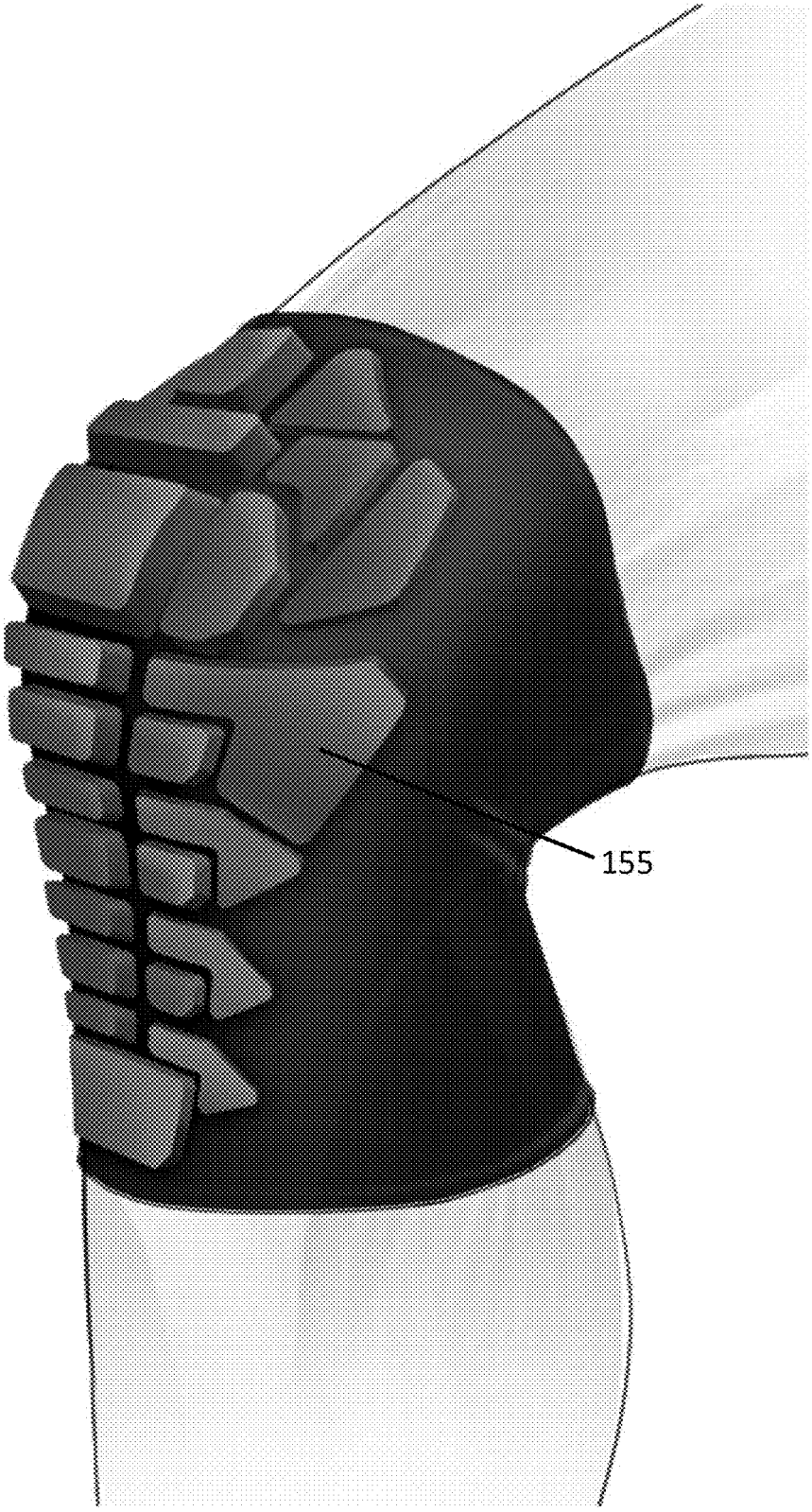
FIG. 7 is a sketch of an alternative embodiment of a knee protector showing placement of a lateral pad.

The decreasing thickness in the pads as they move from the vertical centerline of the protector, horizontally, to the medial and lateral edges of the protector is seen easily in the side view of an exemplary protector in FIG. 4. Decreasing the effective thickness of the knee protector, from the centerline, to its medial and lateral edges, has significant advantages. First, because of the decreased thickness of the pads on the medial and lateral edges, the overall protector is more flexible along the medial and lateral edges. The overall weight and bulk of the protector is decreased, and good padding is provided over the centerline of the knee, which will experience pressure when a wearer is kneeling, but some padding is provided on the edges of the front of the knee and along the sides. This side and edge padding is helpful to protect the knee from obstacles encountered while walking (e.g., tree branches). Additionally, the decreased bulk at the edge of the protector reduces the likelihood of bulges or creases when the protector is flexed with the joint, as shown in FIG. 7.

Another advantage of inventive embodiments comes from the unique shape of the various individual pads 115. Referring still to FIGS. 1-7, and in particular to FIG. 3, the central pads, along the knee vertical centerline (column 125) and in the immediately adjacent pads (flanking columns 130*a, b*) are preferably large in area relative to other pads, and are separated from adjacent pads with narrow channels 122. Additionally, these more central pads preferably have quadrilateral shapes. The combination of these features ensures good coverage across the central portion of the knee, where good padding is advantageous when a wearer is kneeling.

Pads on the medial and lateral vertical edges of the protector (i.e., in columns 135*a, b*), may have triangular shapes (145), where a vertex of each triangle points out in a medial or lateral direction. The consequence of arranging triangular shapes at the medial and lateral vertical edges of the protector is that the channels or space between the individual triangular pads is increased. There is less coverage in these areas, but less is needed since these areas are unlikely to fully bear the weight of the wearer, and the open structure provided by the triangular edge pads is still sufficient to protect the wearer against blows to the sides of the knee. This is the case because these triangular edge pads will tend to bend back around the knee and be arranged on the sides of the knee when the protector is worn. This can be seen in FIG. 7. The open gaps between the medial and lateral pointing vertices of the triangles allow prevents the knee protector from bulging or creasing when the along those sides when the knee is flexed, because there is space that allows the pointed ends of the edge pads to converge toward one another without interference. Some embodiments may include pads that include both quadrilateral and triangular sub-portions, such as pad 150.

Figure 5:
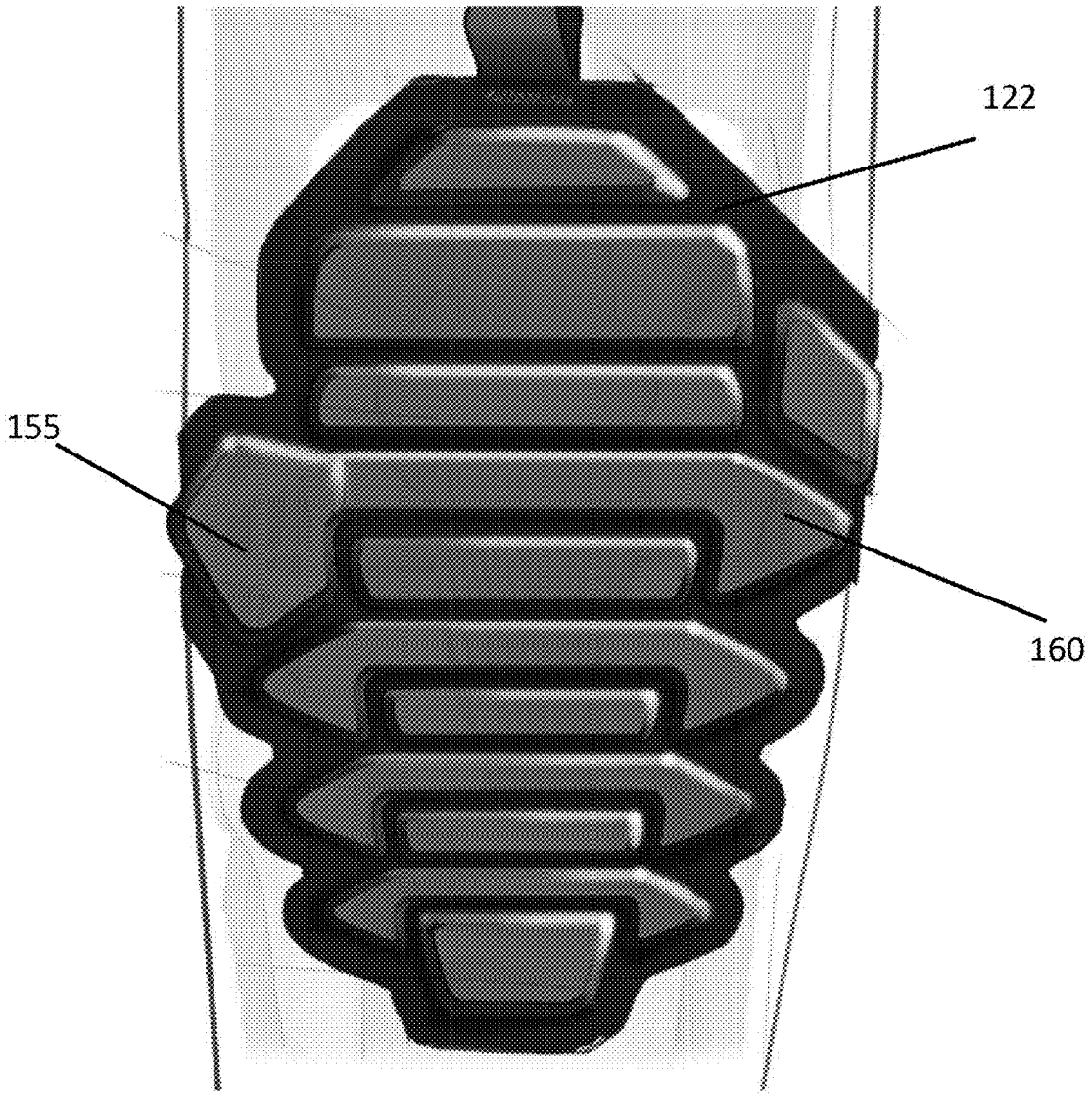
FIG. 5 is a sketch of an alternative embodiment of a joint protector.
Figure 6:
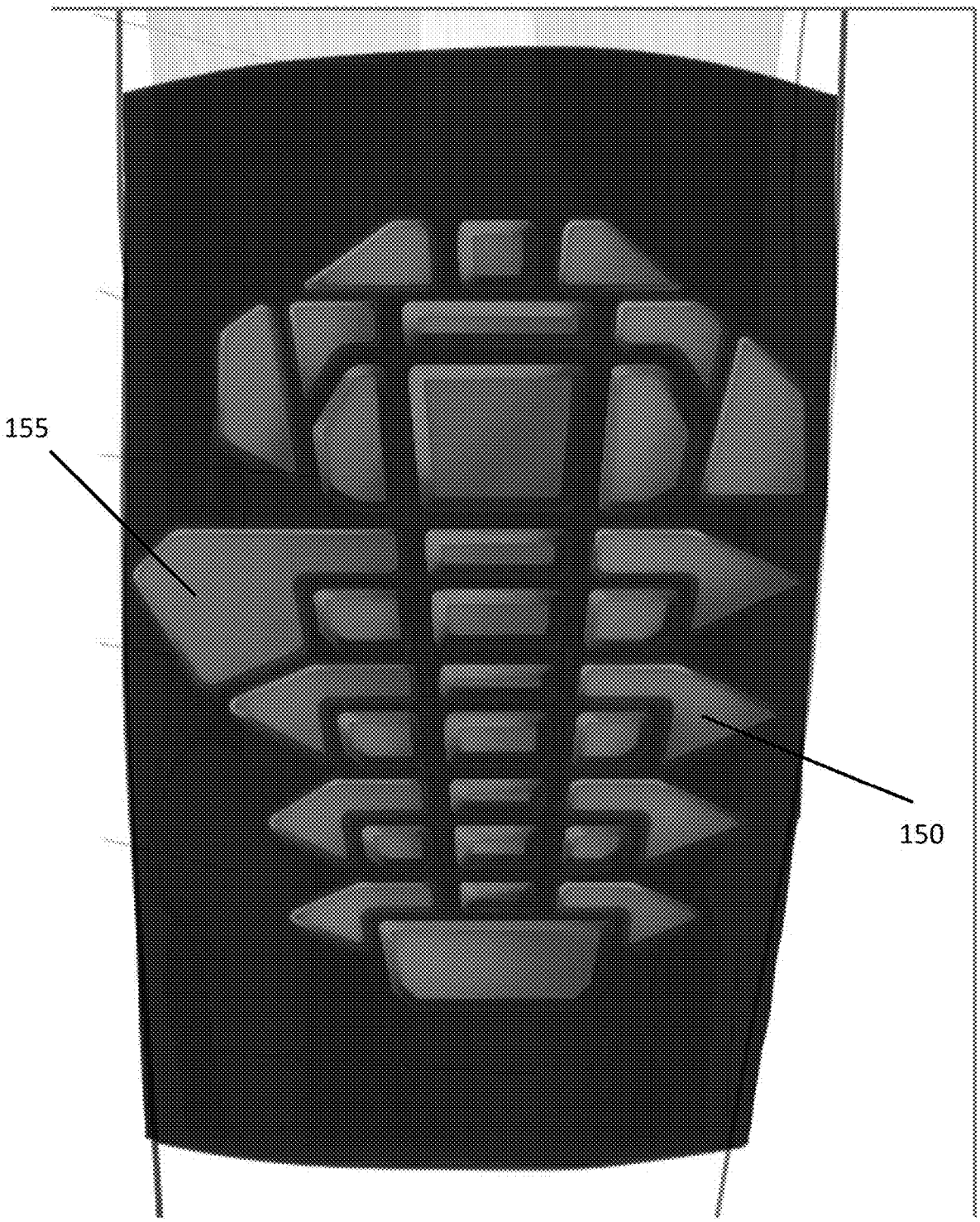
FIG. 6 is a sketch of an alternative embodiment of a joint protector.

Other configurations and arrangements of individual pads are possible and within the scope of the invention. FIGS. 5-7 illustrate alternative configurations of individual pads.

As discussed above, one advantage of knee protectors within the scope of the invention is ability to protect the knee against lateral blows or contact with objects to the side of the knee. To this end, preferred embodiments include a lateral pad that wraps around to be arranged on a lateral side of the knee. Preferably, the joint axis of the knee passes through this pad when the base layer including the protector is worn. The lateral pad is shown as 155 in FIGS. 3, and 5-7, but it is visible in FIGS. 2-3 and 7 (which show left knee protectors) and FIGS. 5-6 (which show right knee protectors). By providing wrap around protection to the joint axis on the lateral sides of the knee, knee protectors within the scope of the invention protect the knee from objects or blows to the side of the knee that may occur while walking.

It should be understood that, unless explicitly stated or otherwise required, the features disclosed in embodiments explicitly described herein and elsewhere in this disclosure may be used in any suitable combinations. Other embodiments and uses of the above inventions will be apparent to those having ordinary skill in the art upon consideration of the specification and practice of the invention disclosed herein. It should be understood that features listed and described in one embodiment may be used in other embodiments unless specifically stated otherwise. The specification and examples given should be considered exemplary only, and it is contemplated that the appended claims will cover any other such embodiments or modifications as fall within the true scope of the invention.

What is claimed is:

1. An athletic base layer garment comprising:

a garment comprising one or more elastic fabric layers, sized to fit tightly to a portion of the body of a wearer;

a padded joint protector integrated into a fabric layer of the garment over a joint of the wearer, wherein the padded joint protector comprises a plurality of individual, conformable pads mutually separated from adjacent pads by open channels;

wherein, the joint protector is a knee protector arranged over the knee of a wearer when the garment is worn;

wherein the joint protector comprises a center column of pads that cover a vertical centerline of the knee of a wearer, and wherein at least one pad in the center column of pads covers the wearer's kneecap;

wherein, the joint protector further comprises flanking columns of pads on either side of the center column;

wherein the joint protector further comprises medial and lateral columns of pads on either side of the flanking columns;

wherein the medial and lateral columns of pads include pads having a triangular perimeter; and wherein the pads having a triangular perimeter are arranged with each pad having a vertex that points out in a medial or lateral direction relative to a vertical centerline of the knee protector.

2. The garment of claim 1, wherein at least some of the pads in the central and flanking columns have a polygonal perimeter.

3. The garment of claim 2, wherein at least of the pads have a triangular perimeter.

4. The garment of claim 2, wherein at least some of the pads have a quadrilateral perimeter.

5. The garment of claim 1, wherein the pads are attached to a common, flexible base layer comprising the same material as the pads of the joint protector.

6. The garment of claim 1, wherein the pads in the central column have a first thickness, the pads in the flanking columns have a second thickness, and the pads in the medial and lateral columns have a third thickness, and wherein the first thickness is greater than the second and third thicknesses.

7. The garment of claim 6 wherein the first thickness is greater than the second thickness and the second thickness is greater than the third thickness.

8. The garment of claim 1, wherein the joint protector includes a lateral pad arranged on the lateral side of the knee when the garment is worn.

9. The garment of claim 8, wherein the lateral pad is arranged to be on the wearer's knee's bend axis when the garment is worn.

10. The garment of claim 1, wherein the joint protector is configured to taper in width from an upper side to a downward side.

11. The garment of claim 1, one or more of the elastic fabric layers includes one or more of the following materials: polyester, nylon, elastane, polypropylene, wool or silk.

12. The garment of claim 1, wherein the padded joint protector comprises one or more of the following materials: polyethylene foam, PVC foam, Neoprene, vinyl nitrile foam, silicone foam, polyurethane, open cell rubber, gels and non-Newtonian fluid cells.

* * * * *